US005765785A

United States Patent [19]

Ortiz Rivas

[11] Patent Number: 5,765,785

[45] Date of Patent: Jun. 16, 1998

[54] STANDARD CROSSING FOR RAILROAD TRACK WITH INTERCHANGEABLE INSERT

[76] Inventor: Arturo A. Ortiz Rivas, Manuel Ma De Llano, No. 1104-D OTE, Monterrey, N.L., Mexico

[21] Appl. No.: 785,289

[22] Filed: Jan. 21, 1997

[51] Int. Cl.[6] ..... E01B 7/00

[52] U.S. Cl. ..... 246/465; 246/472

[58] Field of Search ..... 246/273, 454, 246/460, 462, 463, 464, 465, 466, 467, 472, 375, 376, 377, 378, 379, 380, 381

[56] References Cited

U.S. PATENT DOCUMENTS

| | | | |
|---|---|---|---|
| 136,227 | 2/1873 | Elliot | 246/463 |
| 325,778 | 9/1885 | Wright | 246/463 |
| 1,028,622 | 6/1912 | Smith et al. | 246/465 |
| 1,632,725 | 6/1927 | Brown | 246/465 |
| 1,743,924 | 1/1930 | Kopp | 246/465 |
| 5,393,019 | 2/1995 | Ortiz-Rivas . | |
| 5,456,430 | 10/1995 | Ortiz-Rivas . | |

OTHER PUBLICATIONS

Railway Track & Structures, Nov. 1992, pp. 27–29.

Railway Track & Structures, Mar. 1996, pp. 34–35.

*Primary Examiner*—Mark T. Le

*Attorney, Agent, or Firm*—Pravel, Hewitt, Kimball & Krieger

[57] ABSTRACT

An improved standard crossing for railroad track is provided, having an interchangeable insert. The interchangeable insert permits easy changing of the most commonly worn pieces in situ, and avoids the expense of having to remove and replace the entire crossing when only parts of it are worn or broken. A filler member for fitting in to support and strengthen the crossing, as well as turnouts and other railroad structures, is also provided. The filler member makes it easy to align and assemble the structure, while also supporting the head portion of the rail.

11 Claims, 9 Drawing Sheets

STANDARD CROSSING FOR RAILROAD TRACK WITH INTERCHANGEABLE INSERT

BACKGROUND OF THE INVENTION:

1. Field of the Invention

The present invention relates to railroad track components for crossings and the like.

2. Description of Prior Art

Crossings are devices which have long used in railroads to allow the trains on one set of tracks pass through another set of intersecting tracks. These have been numerous types of railroad crossings used over the years. Examples of these prior types are bolted rail crossings, manganese steel insert crossings, solid manganese steel crossings, and movable point crossings. So far as is known, all these prior crossings have been made of unitary construction, or a one piece device. When any portion of such a prior crossing became worn or broken, the entire crossing element had to be withdrawn from service. At times minor repairs in the nature of maintenance could be made such as by means of welding. However, when the worn or damaged part could not be repaired in this manner, the whole element had to scrapped, even though other parts of the crossing were still useful.

At the present, in crossings, frogs and other rail juncture locations, the design and matching between the rail and fillers for the track components is, so far as is known, based on conforming the fillers by custom fitting to the lateral profile of the rail, the radius of web curvature at the web and the angular lines at head and base. Fillers are the main support of the rails in the frogs, crossings and guard rails. Thus, if the fillers have erroneous measures and do not properly match the track components, the result is a defective product. According to the customary system in the manufacture of the fillers, which are custom-fitted to the rail, when the rail wears out or is broken, the whole track components must be thrown away, even though the other parts are still useful.

SUMMARY OF INVENTION

Briefly, the present invention provides a new and improved railroad track crossing with an interchangeable insert which is based in a new design of a rigid frame that provides high precision to the angles, better working strength and provides for easy replacement or change of the worn or broken parts. According to the present invention, at the intersection of each of the rails at track crossing, high resistance interchangeable inserts are provided. A crossing according to the present invention additionally provides a new angular surface of contact to the vertex of the insert at the intersection.

The new track crossing according to the present invention provides an easy, economical and quick replacement of those high impact parts of the crossing which need repair or replacement more frequently. Due to the features of interchangeability, this crossing is renewed completely by changing only the worn parts. An object of the present invention is to provide a new standard crossing with an interchangeable insert for the railroad track, where the parts which do not engage in contact with the railroad rolling stock remain in service, working virtually indefinitely. The crossing parts which are in contact with the rolling stock during service use, and which are thus subject to being more rapidly worn or broken, can be changed quickly and easily in situ.

A crossing according to the present invention includes an improved rigid frame that is provided for precision definition of the crossing angles, and for provision of strength to the entire crossing structure. A crossing structure according to the present invention also includes a new angular type of contact surface located at the vertex of the insert at the rail crossing intersection. Additionally, the present invention provides an improved interchangeable insert which is made of high resistance steel in order to bear the impact of the wheels of the railway rolling stock. The interchangeable insert is easy to remove and replace or change when it becomes worn or broken. This new and improved crossing according to the present invention also has the advantage that a support rail can be used as replacement when the rail in the side of work requires change. This feature permits the improved crossing of the present invention to contain as its own components replacements and thus provide its owns spare parts.

The present invention also provides a new and improved support design between the rails and fillers for the track components. More particularly, this feature of the present invention provides coupling surfaces on both the rail and the fillers or bars such that instead of the conventional curved coupling surface at the rail web, a flat coupling surface is provided.

The support design feature of the present invention provides a rail for the track components with a flat surface tangent to the radius and along the rail web. It is therefore an object of the present invention to provide a new design matching the fillers and bars with the rail for the track components. The bars and fillers are provided with a flat surface which fits with a flat surface formed in the web of the rail and supported against the rail angles both on the head and base.

The accuracy obtained from the present invention provides the high quality in the manufacture of the track components such as frogs, crossings and guard rails and easy replacement of worn or broken pieces.

An object of the present invention is to avoid the inconvenience of the standard crossing by providing an interchangeable insert which provides dimensional accurateness, reliable performance and important savings in labor and avoiding delays to trains.

Another object of the present invention is to provide a new coupling system between the rail and fillers or bars which at the same time serves as a reference base for the easily alignable and conformable fillers according to the present invention for use with track components such as frogs, crossing and guard rails.

BRIEF DESCRIPTION OF THE DRAWINGS

The characteristic details of the present invention are clearly shown in the following description and accompany figures, which illustrate this and provide points of reference to indicate the same parts in the figures shown.

Figure 1:
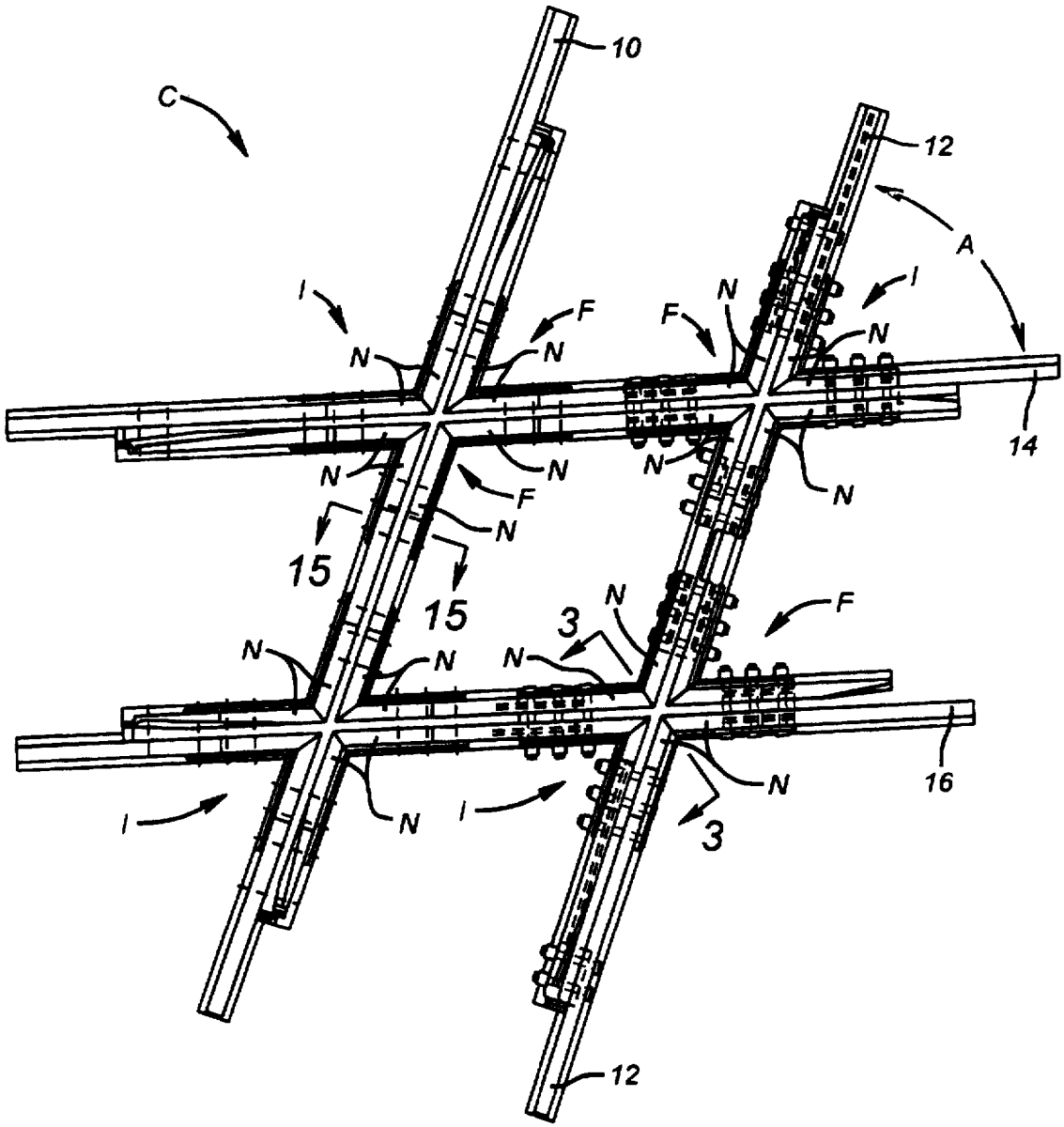
FIG. 1 is a plan view of an improved standard crossing with interchangeable insert according to the present invention.

DESCRIPTION OF PREFERRED EMBODIMENT:

In the drawings, a new and improved railroad crossing C (FIG. 1) according to the present invention is shown. The crossing C is installed at an intersection between a first pair of rails 10 and 12 with a second pair of rails 14 and 16. Each of the two rails in a pair forms an intersection I in the crossing C with the two rails in the other pair, and there are thus four rail intersections I of like construction at the intersection C. An angle A between the rails 12 and 14 depicts the angle or vertex of intersection at the crossing C, and may be any desired acute angle (i.e., less than 90°), right angle (90°) or obtuse angle (i.e., greater than 90°).

Figure 2:
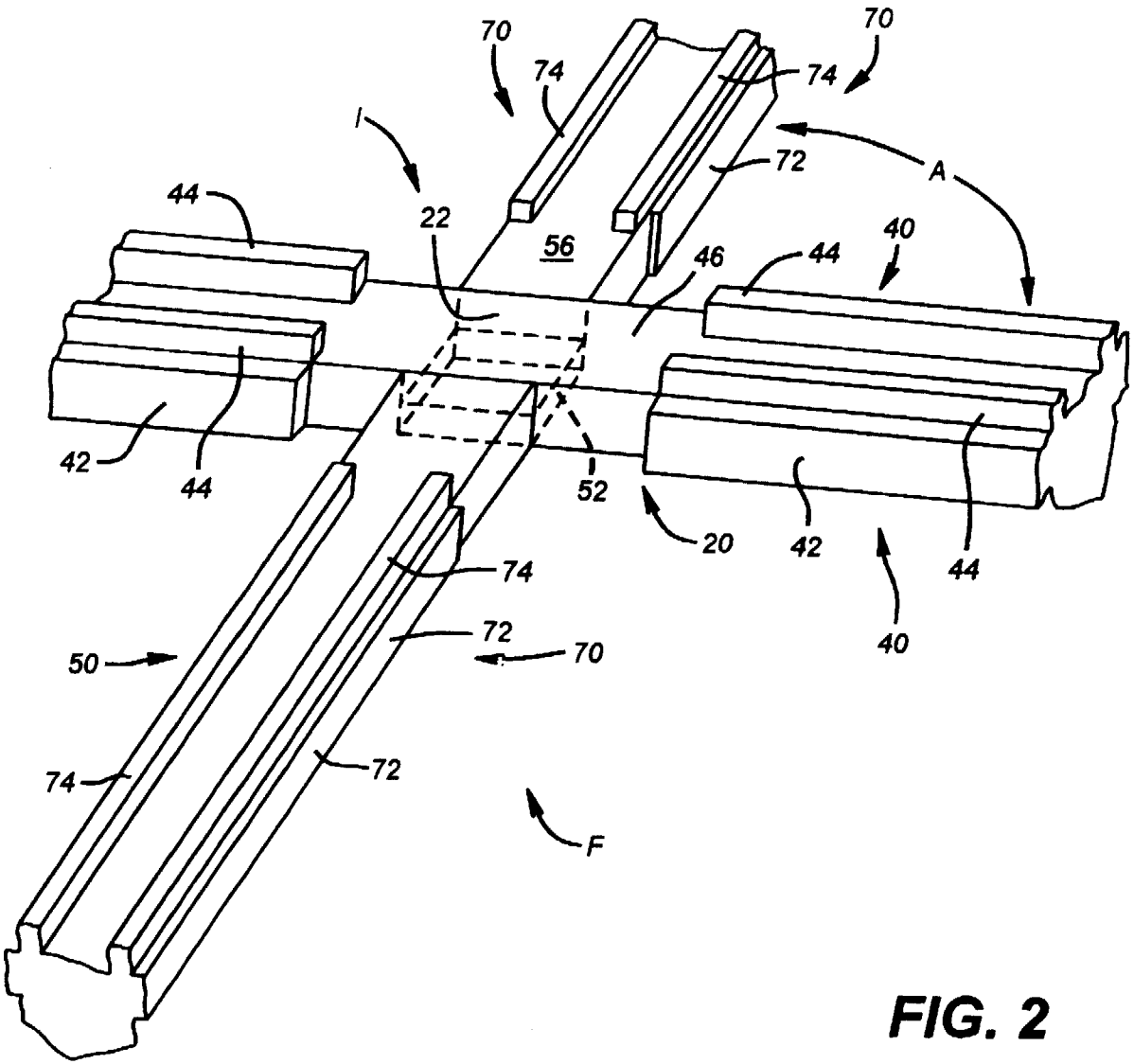
FIG. 2 is an isometric view of the frame of the improved standard crossing of FIG. 1.
Figure 3:
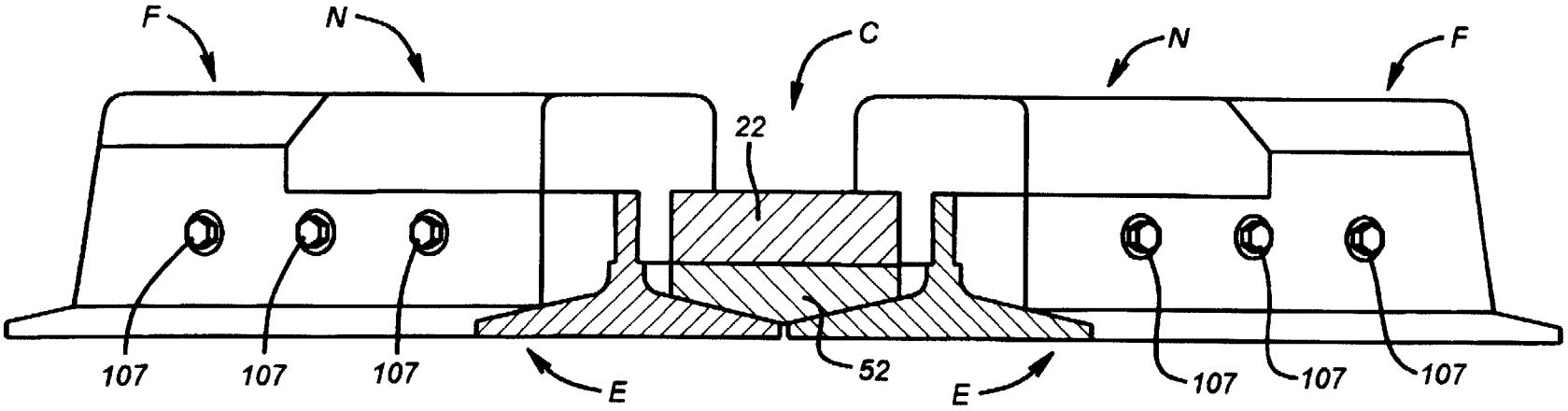
FIG. 3 is a cross-sectional view taken along the lines 3—3 of FIG. 1.
Figure 4:
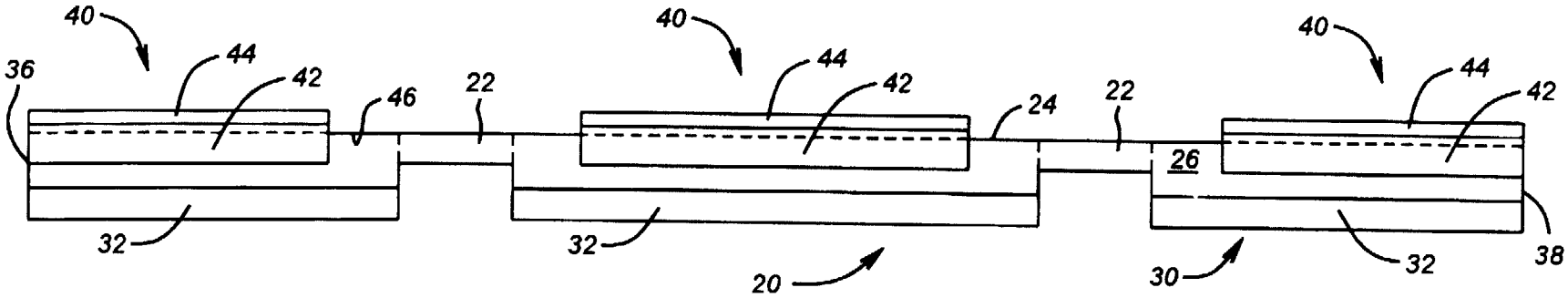
FIG. 4 is a side elevation view of one filler member of a filler member pair forming an insert in the frame of FIG. 2 for a crossing according to the present invention.
Figure 5:
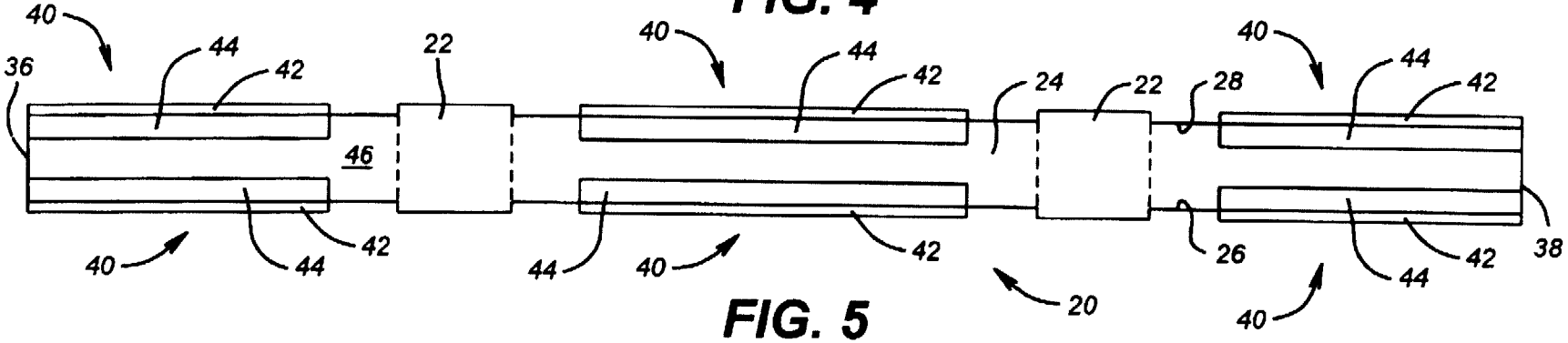
FIG. 5 is a plan view of the filler member of FIG. 4.
Figure 6:
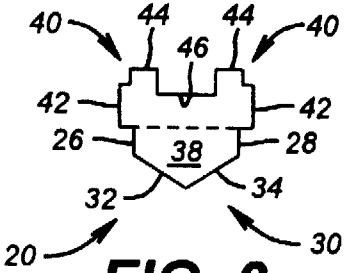
FIG. 6 is a front elevation view of the filler member of FIG. 4.
Figure 7:
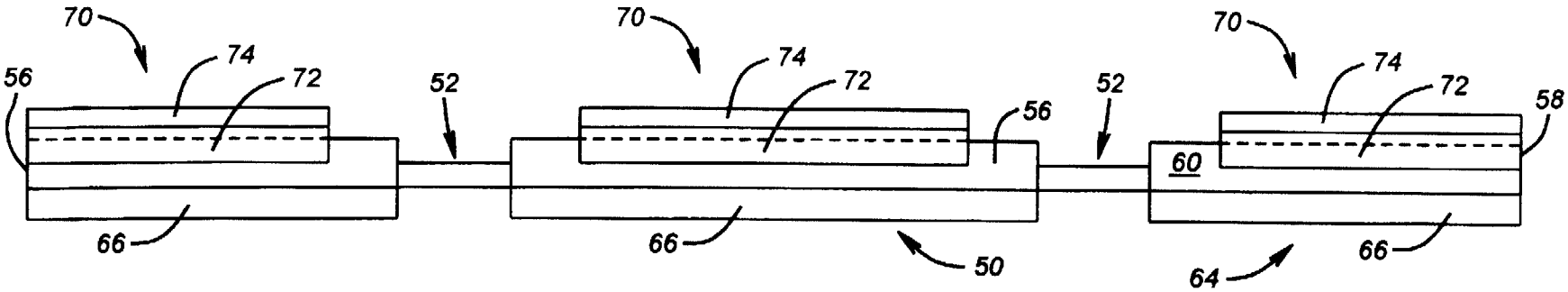
FIG. 7 is a side elevation view of the other filler member of the filler member pair forming an insert in the frame of FIG. 2 for a crossing according to the present invention.
Figure 8:
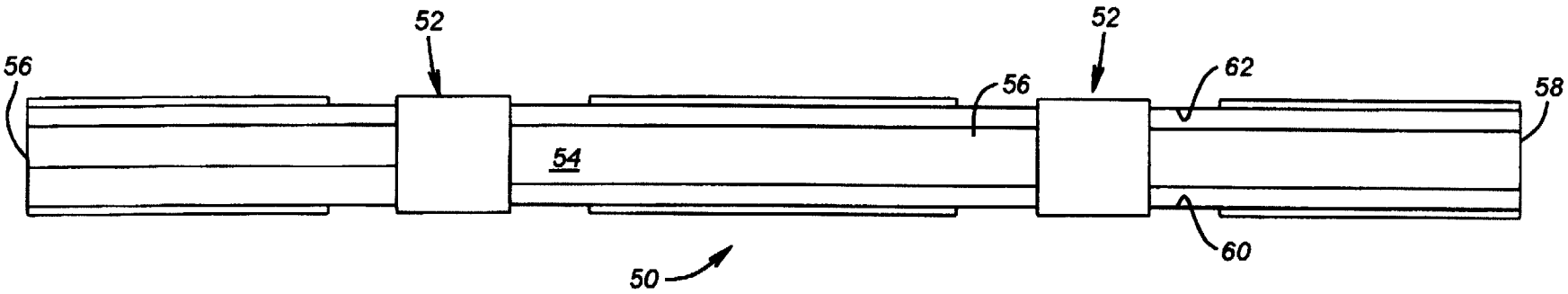
FIG. 8 is a plan view of the filler member of FIG. 7.
Figure 9:
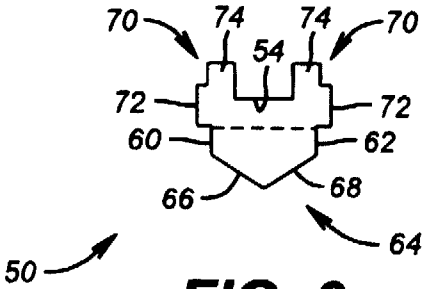
FIG. 9 is a front elevation view of the filler member of FIG. 7.
Figure 11:
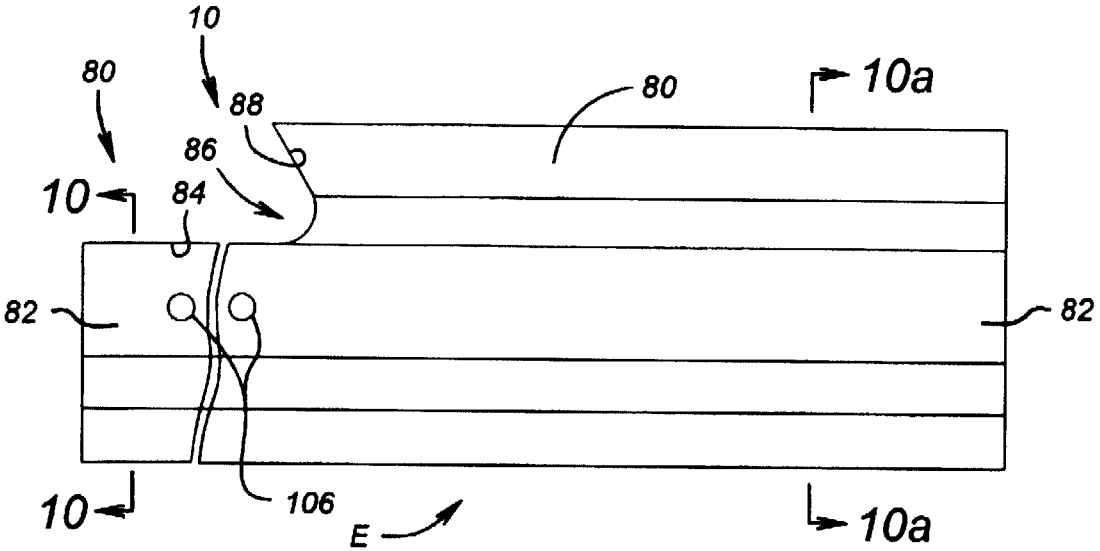
FIG. 11 is a lateral or side elevation view of a support rail insert used in the crossing of FIG. 1.
Figure 12:
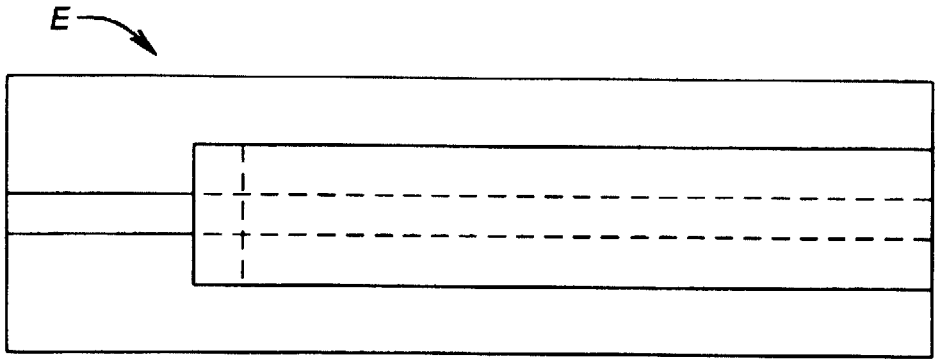
FIG. 12 is a plan view of the support rail insert of FIG. 11.

A crossing frame F (FIG. 2) is formed at each of the four intersections I between the rails in the crossing C. The crossing frames F are defined by a juncture between a first filler member 20 (FIGS. 4–6) and a second filler member 50 (FIGS. 7–9) which intersect at the crossing angle of intersection A.

Considering first the filler member 20, a pair of downwardly extending juncture plates 22 (FIGS. 4 & 5) are formed spaced from each other a distance defined by the railroad gauge, or spacing between parallel rails in the track. The plates 22 are formed in a longitudinally extending beam 24 extending downwardly in a generally rectangular shape between sidewall portions 26 and 28 to a downwardly tapering lower segment 30 formed between inwardly extending lower contact surfaces 32 and 34. Except for the spaces where juncture plates 22 are formed, the beam 24 extends the full length of the filler member 20 between a first end 36 and a second end 38.

A set of three side contact support guides 40 are formed along each of the side walls 26 and 28 along the length of the filler member 20 between the ends 36 and 38. Each of the support guides 40 includes an outwardly extending rib or beam 42 and an upwardly extending strut or bar 44. The ribs or beams 42 of each of the guides 40 extend outwardly from their respective sidewalls 26 or 28, while the struts or bars 44 extend upwardly along each side of a central flat or planar upper surface 46 atop the beam 24.

Considering the second filler member 50, a pair of upwardly facing juncture plates 52 (FIGS. 7 & 8) are formed spaced from each other a distance defined also by the railroad gauge of the track. The plates 52 are formed in a central flat or planar upper surface 54 above a longitudinally extending beam 56 between a first end 56 and a second end 58. The beam 56 also has a lower portion extending downwardly in a generally rectangular shape between side walls 60 and 62 to a downwardly tapering lower segment 64 formed between inwardly extending lower contact surfaces 66 and 68.

A set of three side contact support guides 70 are formed along each of the side walls 60 and 62 of the filler member 50 between the ends 56 and 58. Each of the support guides 70 includes an outwardly extending rib or beam 72 and an upwardly extending strut or bar 74. The ribs or beams 72 of the guides 70 extend outwardly from their respective side walls 60 or 62, while the strut or bar 74 extends upwardly along each side of the central flat 54.

In the filler members 20 and 50, the juncture plates 22 and 52 are shown formed extending at right angles with respect to the longitudinal axes of their respective beams 24 and 56 in order to accommodate a right-angle or 90° angle A of intersection I at a rail crossing C. It should be understood, however, that as detailed above, the relative orientation of the juncture plates may be adjusted, as indicated by an angle 76 according to any desired angle A desired to be formed at the crossing C.

At each intersection I, filler member 20 and a filler member 50 are mounted so that their juncture plates 22 and 52 fit with each other (FIG. 2) thereby thus defining the four intersections I for the crossing C according to the present invention. As has been previously mentioned, the set of four filler members provides an improved rigid frame that enables precise definition of the crossing angle A for the crossing C and also provides strength for the remaining components of the crossing C.

The filler members 20 and 50 are specially machined, unitary structures. They may be formed from steel of lower grade than manganese steel and are thus less expensive. The filler members 20 and 50 define the crossing angle A with precision due to intergagement of their respective juncture plates. The filler members also serve as a base for maintenance of the other crossing components which are subject to higher usage and thus need more frequent replacement In the railroad crossing C, an end portion E (FIGS. 3, 10, 10*a*, 11 and 12) of each portion of the four rails 10, 12, 14, and 16 is preferably modified according to the present invention. After modification, the end portion E is adapted to be fitted with a rail insert N (FIGS. 3, 13, 14, and 14*a*) through an attachment mechanism in the form of a support filler F (FIGS. 3, 16, 16*a*, and 17).

Figure 10A:
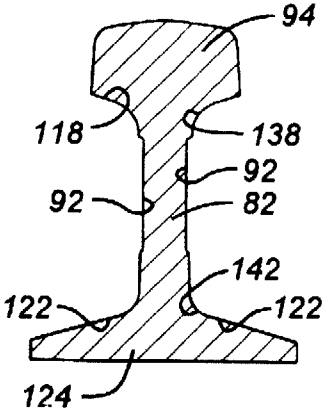
FIG. 10*a* is a cross-sectional view taken along the line 10*a*—10*a* of FIG. 11.
Figure 10:
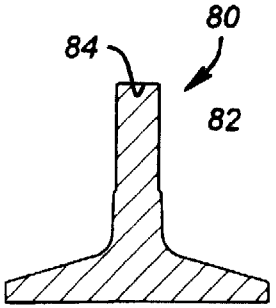
FIG. 10 view is a cross-sectional view taken along the line 10-10 of a support rail insert of FIG. 11.
Figure 14A:
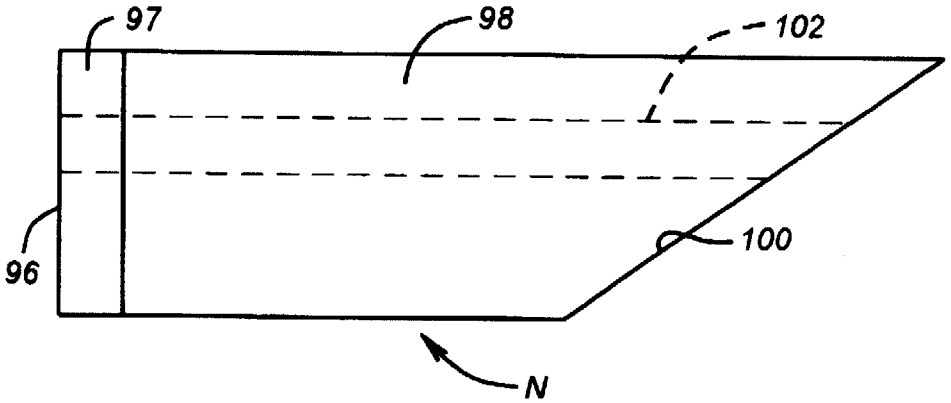
FIG. 14*a* is a plan view of the insert of FIGS. 13 and 14.
Figure 14:
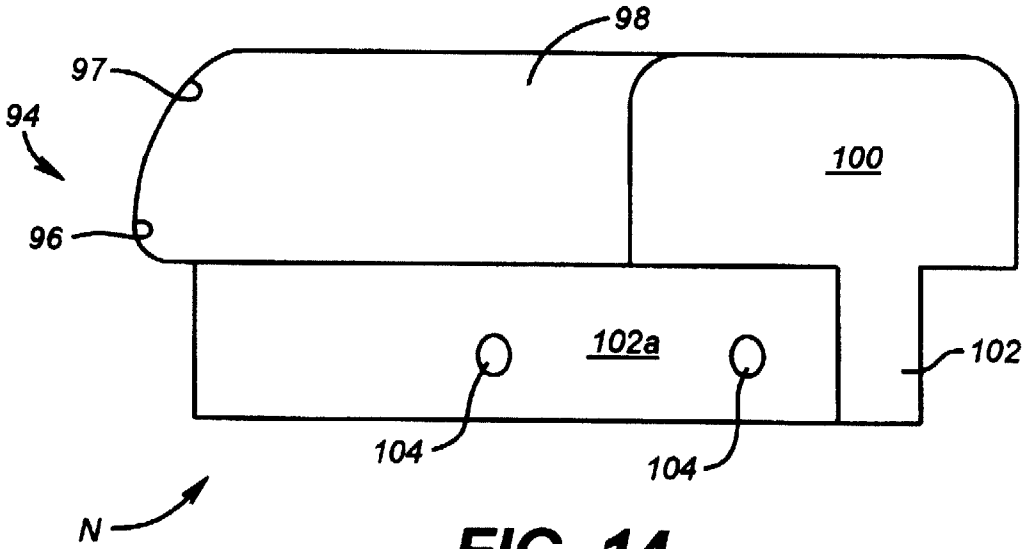
FIG. 14 is a side elevation view of the insert of FIG. 13.
Figure 13:
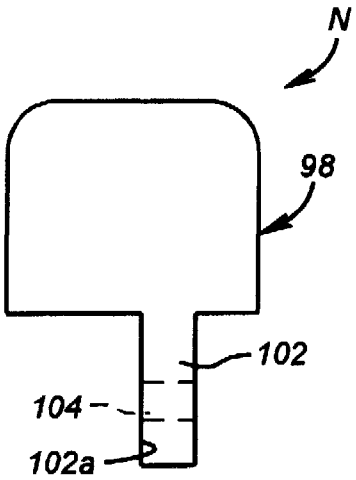
FIG. 13 is a front elevation view of an insert for the crossing of FIG. 1.

The end portion E of a typical one of the four rails, for example the rail 10 is shown in FIGS. 10, 1O*a*, 11 and 12).

On an initial portion 80 of the end E, all of the rail above a web 82 is removed to leave a flat planar support surface 84. The initial portion 80 terminates in a curved recess 86 formed adjacent an upwardly extending tapered flat surface 88 formed on a head or upper wheel contact portion 90 of the rail 10. The shape of the tapered flat surface 88 and recess 86 are formed to match and form engaging surfaces with corresponding portions of the insert N, as will be set forth. The recess so formed at the juncture of end portion E and insert N is furnished for better load bearing capabilities. The web 82 of the end portion E is also machined to have substantially flat side vertical surfaces 92 formed on each side thereof The rail insert N (FIGS. 13, 14, and 14*a*) has a rear connector surface 94 including a lower curved surface 96 formed of a like shape to the curved recess 86 of the rail end portion E. A tapering surface 97 adapted to mate with and conform to the surface 88 of the rail end E is formed extending upwardly from the curved surface 96. The rail insert N further includes an upper portion or head 98 of similar shape to ahead or wheel contact portion 90 of the rail 10. The head 98 of the rail insert N extends from rear connector surface 94 to a diagonally formed vertical planar intersection or juncture surface 100. The surface 100 is formed on an angle with respect to the longitudinal extent of the end portion E conforming to the angle A of intersection at the rail crossing C and defining an intersection angle of equal measure. The intersection angle so formed defines a planar surface and intersection angle with a planar load transition surface without angles, edges or other non-planar features to receive and amplify wheel impacts.

A downwardly extending support and attachment bar 102 is formed having flat side surfaces 102*a* adapted to mate with flat surface 92 on the rail end portion E. The bar 102 extends along the full length of the lower portion of the insert N. A suitable number of openings or passages 104 are formed in the bar 102 and are adapted to be aligned with similar openings 106 in the rail web 92 and receive connector bolts 107 for connection purposes.

The support filler F (FIGS. 16, 16*a*, and 17) includes a laterally extending contact or portion 108 extending outwardly from a central beam or upright 1 10. The contact 108 has a vertically extending, substantially flat contact surface 108*a* adapted to mate with and be fitted against the flat surface 92 of the rail end portion E. Connector passages 112 are formed in the support filler F to be aligned with the openings 104 and 106 for passage of connector bolts 114 for assembly purposes.

Figure 19:
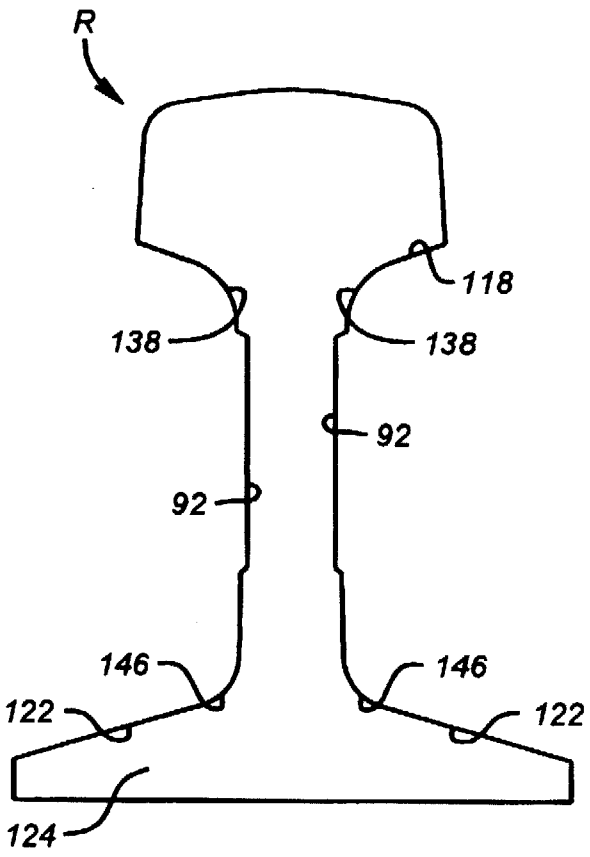
FIG. 19 is a cross-sectional view of a rail component of the crossing of FIGS. 1 and 15.
Figure 15:
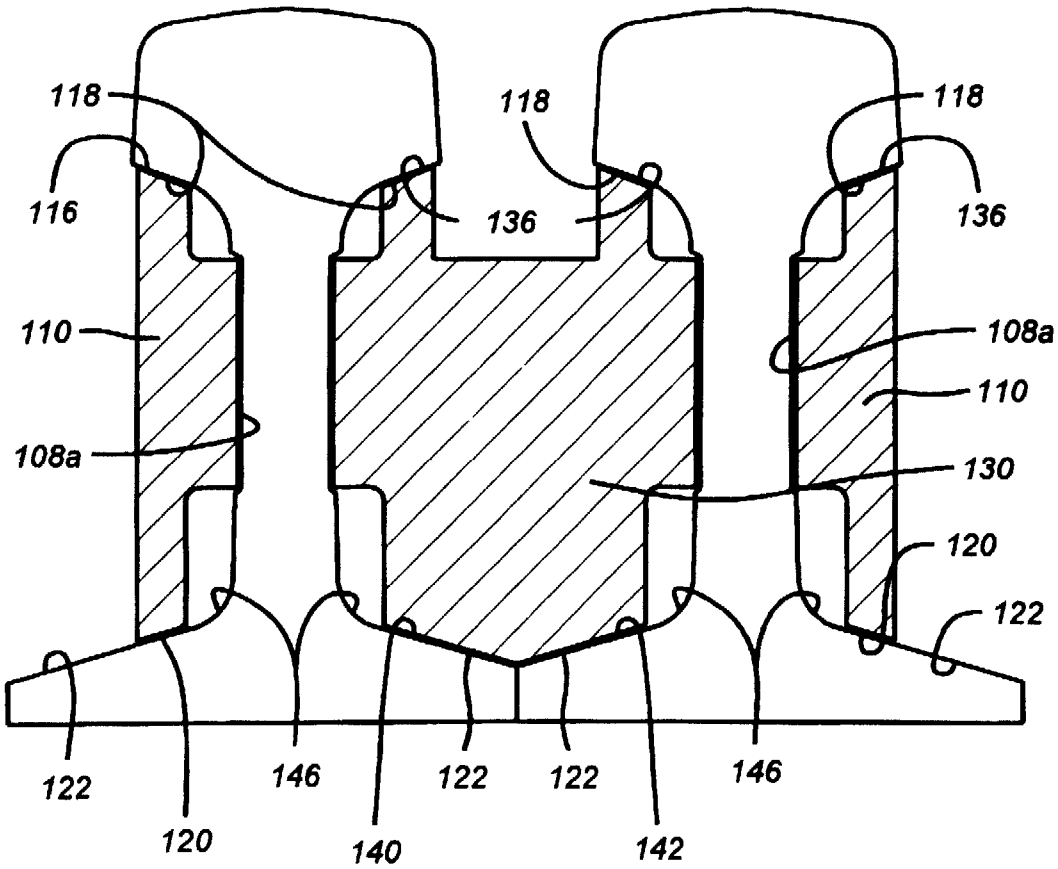
FIG. 15 is a cross-sectional view taken along the lines 15—15 of FIG. 1
Figure 16A:
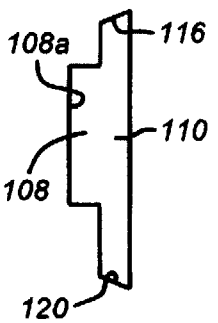
FIGS. 16 and 16*a* are front and rear elevation views of an improved insert of the present invention for the crossing of FIGS. 1 and 15.
Figure 17:
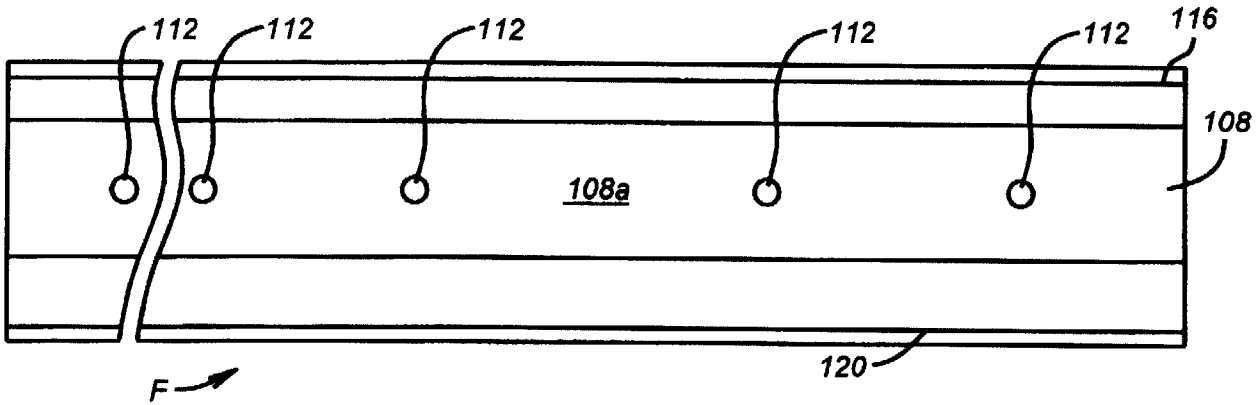
FIG. 17 is a lateral or side elevation view of the improved bar of FIGS. 1 and 15.
Figure 16:
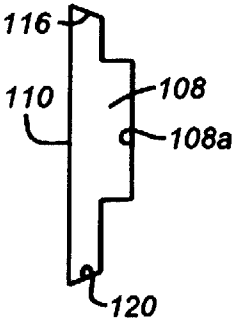

The upright 110 of the support filler F has an upper surface 116 formed on it conforming to a lower surface 118 (FIGS. 10*a* & 19) beneath the wheel contact portion 90 of the rail 10 and end portion E. A sloping lower surface 120 is formed on the support filler F conforming to a planar upper surface 122 of a base portion 124 of the rail end E. The surfaces 120 and 116 of the support filler F thus conform to and contact corresponding surfaces on the rail end portions E and the rail insert N of the rail crossing C, providing additional load bearing support in the crossing C. The engagement of the contact surface 108 of the support filler F with the flat surface 92 on the rail end portion E insures that the surfaces 120 and 116 are firmly in place and in engagement with the corresponding portions of the crossing C. Any weakness resulting from the flats formed on the webs 82 of the rails R or end portions E is thus offset by the support contact afforded by the surfaces 120 and 116 and the load bearing capability of the support filler F.

The support filler F also provides a new and improved flat system of support according to the present invention between the rails, bars and fillers for track components such as frogs, crossings, and guard rails.

Each rail R (FIG. 19) which is going to form part of a track component, such as the crossing, frog, turnout, guard rail or the like, has a flat lateral plane on a surface 92 in the same manner as like numbered structure on the end portion E. This provides for a precise measurement and alignment reference for the other structure of the track component.

Based on the initial side plane or surface 92 of the web 82 of the rail, a side plane 128 on a filler block 130 (FIG. 18), is made and the height kept throughout the length of filler block 130. It should be understood that the surface 108*a* of support filler F is also formed in a similar manner. An upright 134 is formed extending upwardly from filler block 130 at two spaced positions inwardly from the side plane 128. The inward spacing of upright 134 from plane 128 is chosen so that an upper surface 136 of upright 134 avoids any contact with a curved radius section 138 beneath the head 90 of the rail R or end portion E. The filler block 130 also has offset downwardly inwardly sloping planar lower surfaces 140 and 142 at a lower portion 144. The amount of offset or spacing of surfaces 140 and 142 is also chosen to contact the planar surface 122 of rail R or end portion E and avoid contact with a curved inner portion 146 where the web 82 and base 124 join.

A groove 148 is formed between uprights 134 in order to allow the passage to the flange of the wheels of the railroad cars and engines.

It is to be noted that both the rail filler F and the filler block 130 can be made from less expensive conventional steel, since they are spaced from contact with railroad wheels, and thus are not subject to repeated impact and high wear.

The present invention thus allows the easy and precise manufacture of bars and fillers. Further, these pieces have a service life limited only by the steel life, since is quite difficult for these parts to become broken or worn during use. This means savings in time, money, and security in operation for the frogs, crossings, and guard rails.

The improved design of the present invention also provides a reference point which is the base for accuracy in assembly and manufacture of every part of a track component such as frogs, crossing or guard rails, at the same time strengthening the head rail resistance due to impact and loads to the matching planar surfaces between the rail and the fillers.

In assembling a rail crossing C according to the present invention, the four rails 10, 12, 14, and 16 are modified to have the end portion E formed thereon. Next, the crossing frame F is formed at each of the intersections I from the filler members 20 and 50. The crossing frames F are then assembled with the end portions E, and the inserts N are then fitted together with the assembled components. Rail bolts 107 are then inserted to form the crossing C into a rugged, durable unit.

It is to be noted that the contact surfaces 100 of each of the inserts N is a substantially flat continuous planar surface which is adapted to contact a similarly formed surface of corresponding extent and area in the rail crossing C. This substantially planar engagement surface provides a load transition point in contrast to the prior art interfittings at railroad crossings which have reduced area surfaces which directly receive the impact of the wheel at the rim transition in the intersection angles of the rails. Further, the recessed area formed at connector surface 94 and curved surface 96 of the rail insert N at the juncture provides better load bearing characteristics against the loads imparted to the crossing C as railroad rolling stock moves thereacross during service use.

Further, the rail fillers of the crossing frame F and filler blocks 130 according to the present invention may be formed from specially machined, one-piece members, of lower quality than manganese steel. The rail filler F define the crossing angle of the A of the crossing C with precision, because their intersections define the crossing angle as has been set forth above. Further, the filler members serve as the base for maintenance from which the worn, high usage item such as the inserts N and support rails S may be replaced by removing them from the fillers and replacing them with new ones, rather than requiring removal and replacement of the entire crossing C. The filler blocks 130 afford the same advantages.

It should be understood that the crossing frame F may be made of a single unitary structure rather than two assembled filler members, if desired. Such a unitary structure could also be used in railroad frogs as rail support at the wings.

Figure 20:
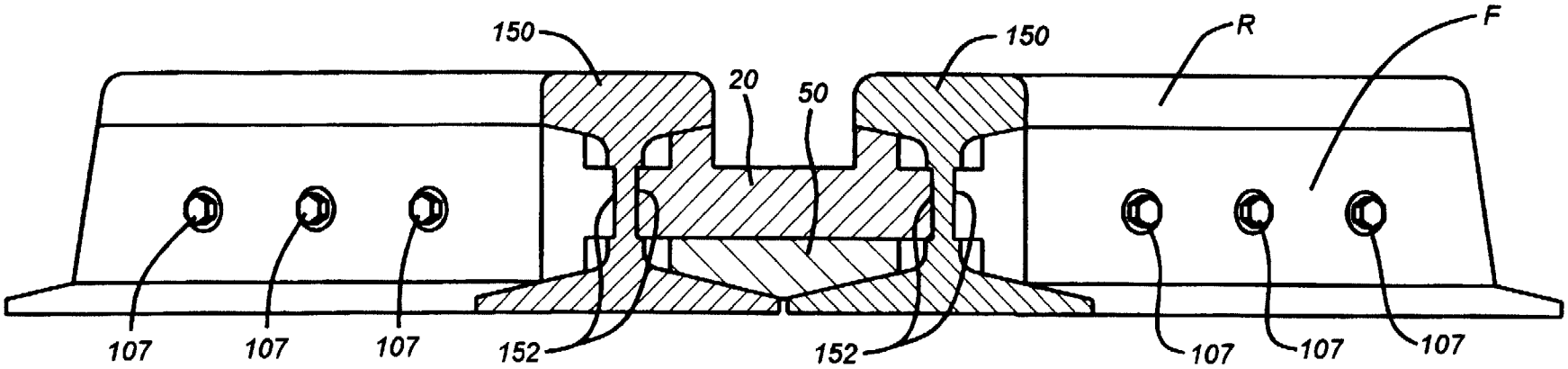
FIG. 20 is a cross-sectional view of an alternate structure according to the present invention taken along the same lines in that alternate structure as the lines 3—3 of FIG. 1.
Figure 18:
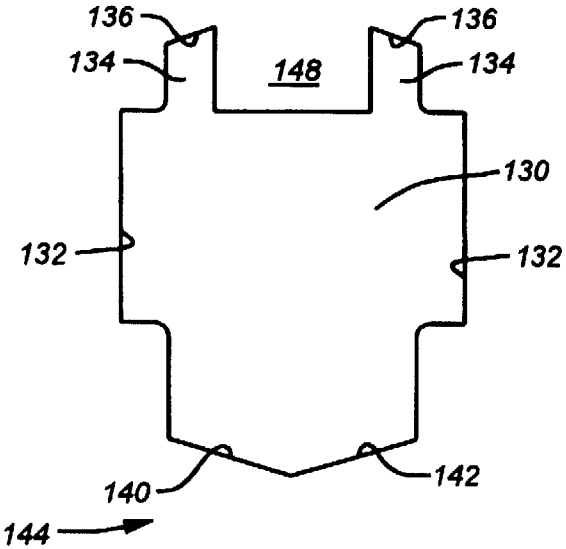
FIG. 18 is a cross-sectional view of a filler member component of the crossing of FIGS. 1 and 15.

In some instances, for reasons of economy, it may be desirable to form flat, vertical planar intersections or juncture surfaces directly on the end portions of the intersecting rails 10, 12, 14, and 16 in the crossing C (FIG. 18). In this situation, each of the rails forming the crossing C is machined to have a diagonally formed vertically planar intersection or juncture surface 150 (FIG. 20) adapted to mate with and transfer load with a corresponding surface of the adjacent rail. The end portions of the rails themselves are then machined to have side flat surfaces 152 formed thereon to mate with and contact with the contact surface 108*a* on the support rail S. This structure of machined and modified rail ends could also be used in railroad frogs, if desired.

Having described the invention above, various modifications of the techniques, procedures, material and equipment will be apparent to those in the art. It is intended that all such variations within the scope and spirit of the appended claims be embraced thereby.

I claim:

1. A railroad track crossing having first and second sets of rails which intersect each other, and further having an improved rail intersection structure comprising:

each of said rails including:

an end portion having an inwardly extending curved recess formed in a head portion thereof;

a rail insert having said planar end surface formed thereon;

said rail insert having a head portion of like cross-sectional shape to said head of said rail;

said rail insert having a tapering surface formed thereon adapted to fit in said recess in said rail end portion, and connectors for attaching said rail insert to said rail end portion; and first and second filler members attached between said rail and mounted intersecting each other at an angle defining an angle of crossing of said sets of rails in said crossing; and each of said rails of said crossing having a planar end surface formed thereon to mate against and engage a corresponding planar end surface formed on a head portion of another of said rails intersecting therewith.

2. The railroad track crossing of claim 1, wherein each of said filler members has a juncture plate formed thereon at each point of intersection with another of said filler members.

3. The railroad track crossing of claim 2, wherein said juncture plates of said filler members engage each other at their respective point of intersection.

4. The railroad track crossing of claim 1, further including support filler members, each of which is mounted to a side of one of said intersecting rails an wherein:

each of said support filler members has an inwardly extending planar contract surface thereon for mounting on a corresponding planar flat surfaces on a base portion of said rail with which said support filler member is mounted.

5. The railroad track crossing of claim 1, further including support filler members each of which is mounted to a side of one of said intersecting rails and wherein:

Each of said support filler members has an laterally outwardly extending planar contact surface thereon to engaging a corresponding planar flat surface on a web portion of said rail with which said support filler member is mounted.

6. The railroad track crossing of claim 1, further including support filler members each of which is mounted to a side of one of said intersecting rails and wherein:

each of said support filler members has an upwardly extending upright having a planar upper contact surface thereon for engaging on a corresponding planar flat surface below a head portion of said rail with which said support filler member is mounted.

7. The railroad track crossing of claim 1, further including support filler members each of which is mounted to a side of one of said intersecting rails and wherein:

each of said support filler members has an inwardly extending planar contact surface thereon for mounting on a corresponding planar flat surfaces on a base portion of said rail with which said support filler member is mounted;

each of said support filler members has an laterally outwardly extending planar contact surface thereon for engaging a corresponding planar flat surface on a web portion of said rail with which said support filler member is mounted; and each of said support filler members has an upwardly extending upright having a planar upper contact surface thereon for engaging on a corresponding planar flat surface below a head portion of said rail with which said support filler member is mounted.

8. The railroad track crossing of claim 1, wherein:

said planar end surface of said rail of said crossing is formed on a head portion of an end portion of said rail.

9. A railroad track crossing having first and second sets of rails which intersect each other, and further having an improved rail intersection structure comprising:

first and second filler members attached between said rails and mounted intersecting each other at an angle defining an angle of crossing of said sets of rails in said crossing;

support filler members, each being mounted to a side of one of said intersecting rails;

each of said rails of said crossing having a planar end surface formed thereon to mate against and engage a corresponding planar end surface formed on a head portion of another of said rails intersecting therewith; and each of said first and second filler members and support filler having a laterally outwardly extending rib including a planar flat surface for engaging a corresponding planar flat surface on a web portion of said rail with which said filler member is mounted.

10. The railroad track crossing of claim 9, including:

each of said support filler members having an inwardly extending planar upright contact surface thereon for mounting on a corresponding planar flat contact surfaces on a base portion of said rail with which said support filler member is mounted.

11. The railroad track crossing of claim 9, including:

each of said support filler members having an upwardly extending upright having a planar upper contact surface thereon for engaging on a corresponding planar flat surface below a head portion of said rail with which said support filler member is mounted.

* * * * *